US011548051B2

(12) United States Patent
Akiba et al.

(10) Patent No.: US 11,548,051 B2
(45) Date of Patent: Jan. 10, 2023

(54) PRESS FORMING METHOD

(71) Applicant: HONDA MOTOR CO., LTD., Tokyo (JP)

(72) Inventors: Hirokatsu Akiba, Tochigi-ken (JP); Takeshi Sano, Tochigi-ken (JP); Kenji Matsutani, Tochigi-ken (JP); Takayuki Kano, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/764,895

(22) PCT Filed: Nov. 19, 2018

(86) PCT No.: PCT/JP2018/042728
§ 371 (c)(1),
(2) Date: May 18, 2020

(87) PCT Pub. No.: WO2019/102972
PCT Pub. Date: May 31, 2019

(65) Prior Publication Data

US 2020/0338618 A1 Oct. 29, 2020

(30) Foreign Application Priority Data

Nov. 21, 2017 (JP) ..... JP2017-223384

(51) Int. Cl.
*B21D 22/26* (2006.01)

(52) U.S. Cl.
CPC ..... *B21D 22/26* (2013.01)

(58) Field of Classification Search
CPC ..... B21D 22/20; B21D 22/26; B21D 22/22; B21D 22/24
See application file for complete search history.

(56) References Cited

U.S. PATENT DOCUMENTS 9,724,745 B2 * 8/2017 Maeda ..... B21D 22/22
9,849,500 B2 * 12/2017 Presset ..... B21D 22/24
(Continued)

FOREIGN PATENT DOCUMENTS

DE 102011115219 3/2013

OTHER PUBLICATIONS

International Search Report and Written Opinion for International Application No. PCT/JP2018/042728 dated Feb. 12, 2019, 8 pages.

*Primary Examiner* — Teresa M Ekiert
(74) *Attorney, Agent, or Firm* — Amin, Turocy & Watson, LLP

(57) ABSTRACT

The present invention is a press forming method for obtaining a target formed article that has an edge-shaped ridge section and that has a negative surface on one side and a positive surface on the other side with respect to the ridge section as a border, said press forming method including: a first step for forming an intermediate formed article having an intermediate ridge section having a larger radius than the edge radius of the ridge section; and a second step for forming the target formed article from the intermediate formed article. The intermediate formed article has a first intermediate positive surface that corresponds to the site extending from the ridge section to the negative surface of the target formed article and also has a second intermediate positive surface that corresponds to the site extending from the ridge section to the positive surface of the target formed article and that continues from the first intermediate positive surface and an intermediate negative surface continuing from the second intermediate positive surface.

3 Claims, 8 Drawing Sheets

(56) References Cited

U.S. PATENT DOCUMENTS

| | | | | |
|---|---|---|---|---|
| 10,252,312 | B2 * | 4/2019 | Kubo | B21D 5/01 |
| 10,807,137 | B2 * | 10/2020 | Otsuka | B21D 5/01 |
| 2009/0272171 | A1 * | 11/2009 | Golovashchenko | G06F 30/23 72/348 |

* cited by examiner

PRESS FORMING METHOD

TECHNICAL FIELD

The present invention relates to a method for manufacturing a press formed article having a ridge portion on a design surface thereof. A press formed article according to the present invention is applied to the hood, the side panel, the door panel, and the like of an automobile and used as, for example, an outer panel for an automobile door.

BACKGROUND ART

An outer panel for an automobile door is manufactured generally by press forming of a metal plate member. An outer panel is a section that determines the design of an automobile and designed so as to have, for example, a negative surface (concave surface) and a positive surface (convex surface) with respect to a ridge portion (referred to as a character line) having a small curvature radius. A high press forming technique is required to form such an outer panel.

German Patent Application Publication No. 102011115219 discloses a press forming method for a metal plate member in which an edge portion is preformed and the section other than the edge portion is formed in a final shape using a first metal mold, and then the edge portion is formed in a final shape using a second metal mold. The edge diameter formed by the first metal mold is approximately two to ten times as large as that of the final shape and formed in a predetermined size via two-stage deep drawing. This patent literature does not disclose matters about a negative surface and a positive surface or the correction of strains.

In the forming of a panel or the like that has a negative surface and a positive surface, tensile and compression stresses are generated by bending in the first process. When bending in the same direction as in the first process is performed and tensile and compression stresses are further applied in the second process, lines or asperities are generated as strains on the design surface. To correct such strains, there is a correcting method in which building-up is performed on the lower mold for each of points at which strains are generated in the second process, and the built-up part is strongly pushed against the strains immediately before the upper mold is moved relative to the lower mold and reaches the bottom dead center. Building-up may be performed on the upper mold as long as the design is not affected.

SUMMARY OF INVENTION

The method that corrects strains by performing building-up on the metal mold requires many experiences, much time for adjustment, and high press loads if the number of correction points is large, so high facility capability is necessary.

The present invention is based on the idea of reducing strains by bending, in the second process, in the direction opposite to that in the first process. An object of the present invention is to provide a press forming method that reduces the generation of strains as much as possible in the press forming of a target formed article having a ridge portion.

According to the present invention, there is provided a press forming method for obtaining a target formed article that has an edge-shaped ridge portion and has a negative surface on one side and a positive surface on another side with respect to the ridge portion as a border. The press forming method includes: a first process for forming an intermediate formed article having an intermediate ridge portion with a radius larger than an edge radius of the ridge portion; and a second process for forming the target formed article from the intermediate formed article. The intermediate formed article has a first intermediate positive surface that corresponds to a section of the target formed article, the section extending from the ridge portion to the negative surface, and has a second intermediate positive surface continuous with the first intermediate positive surface and an intermediate negative surface continuous with the second intermediate positive surface, the second intermediate positive surface and the intermediate negative surface corresponding to a section of the target formed article, the section extending from the ridge portion to the positive surface.

In the press forming method described above, since the first process and the second process are combined so as to cancel tensile and compression stresses generated by bending, points at which strains are generated can be minimized. This reduces building-up points on the metal mold, thereby enabling reduction in the time required to increase the accuracy of the metal mold.

In the press forming method described above, the target formed article and the intermediate formed article preferably have identical shapes in regions on both sides of the intermediate ridge portion and, when the target formed article and the intermediate formed article are superimposed on each other, a vertex of the intermediate formed article is preferably located lower in a press stroke direction than a vertex of the target formed article. Since this plastically deforms the intermediate formed article so as to increase forming depth in the second process, the shape of the target formed article can be stabilized.

In addition, the second intermediate positive surface preferably intersects with the positive surface in a state in which the target formed article and the intermediate formed article are superimposed on each other. This can deform the intermediate formed article at an appropriate elongation rate in the second process.

The press forming method according to the present invention reduces the generation of strains by combining the first process and the second process so as to cancel tensile and compression stresses generated by bending. Thus, a highly accurate facility is not required even when strains are corrected.

DESCRIPTION OF EMBODIMENTS

Figure 1:
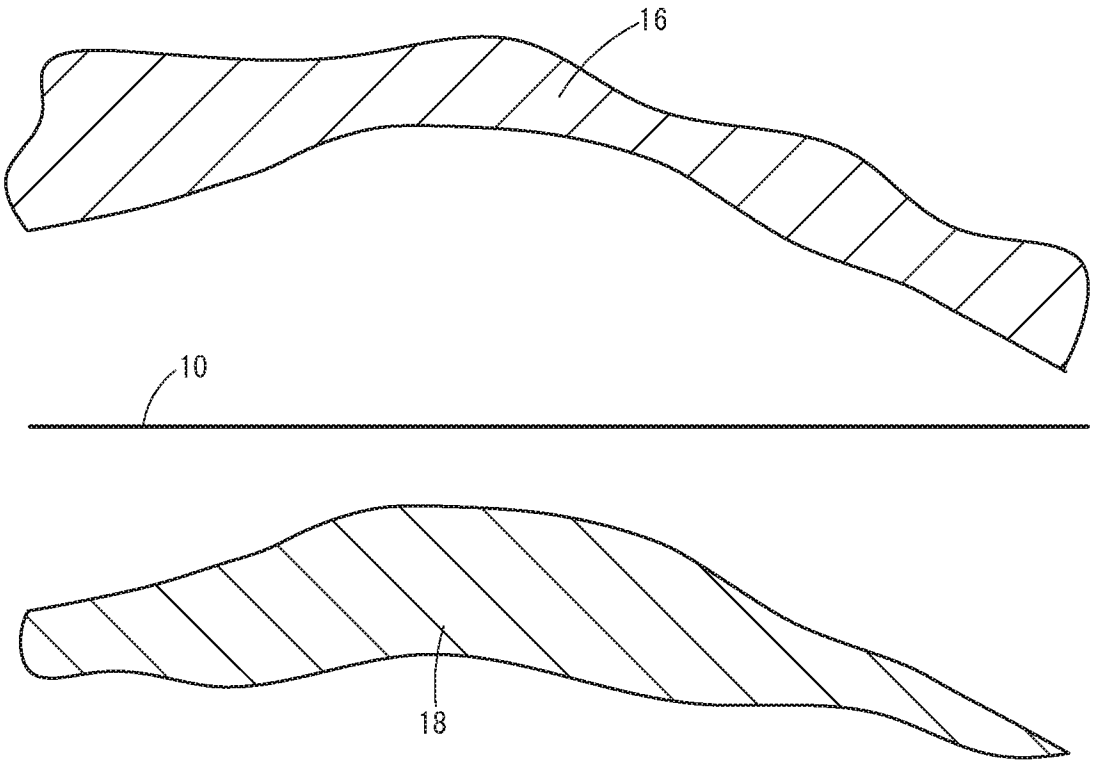
FIG. 1 is a schematic view of a first process and describes the basic concept of the present invention.
Figure 2:
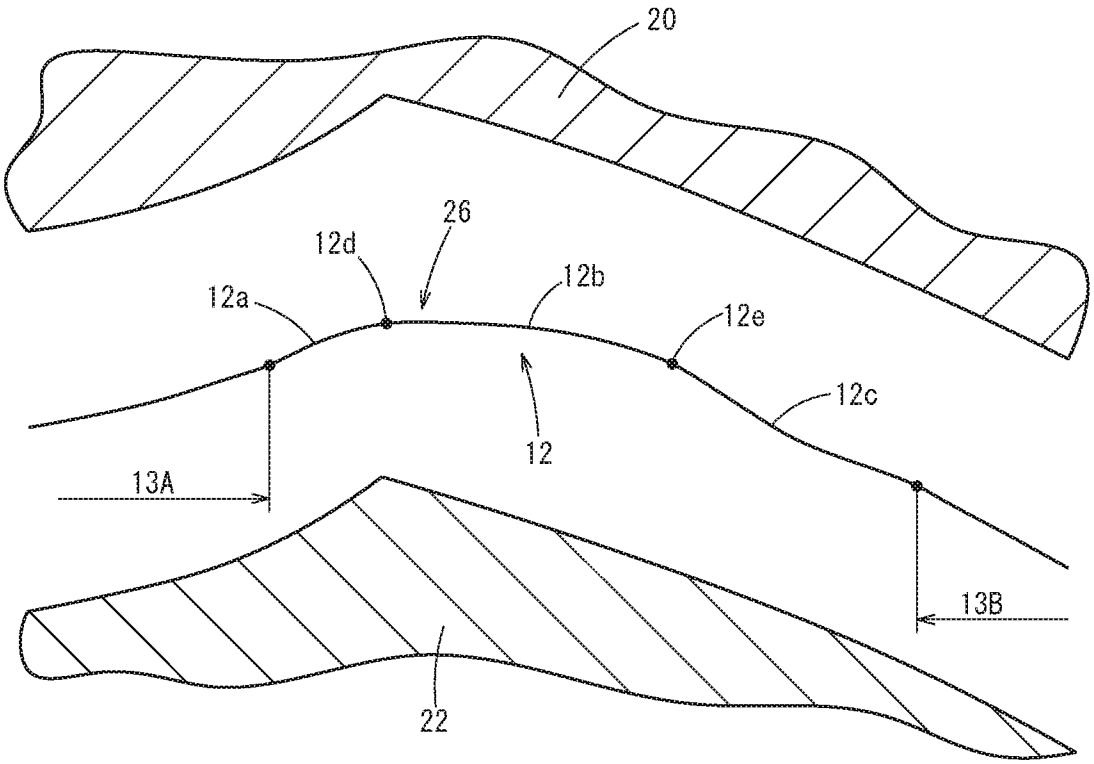
FIG. 2 is a schematic view of a second process and describes the basic concept of the present invention.

First, the basic concept of a press forming method according to the present invention will be described below with reference to FIGS. 1 to 3.

The present invention is applied to the hood, the side panel, the door panel, and the like of an automobile. As illustrated in FIGS. 1 to 3, a target formed article 14 is obtained by press forming of a plate member 10 made of steel or aluminum alloy in two stages. That is, an intermediate formed article 12 is obtained from the plate member 10 via press forming using a first upper mold 16 and a first lower mold 18 in a first process, and the target formed article 14 is obtained from the intermediate formed article 12 via press forming using a second upper mold 20 and a second lower mold 22 in a second process. In the form of the press forming, it is preferable to perform drawing forming while supporting the peripheral portion of the plate member 10 or the intermediate formed article 12 and applying tension, but the press forming is not limited to drawing forming. In FIGS. 2 and 3, only the main portions of the intermediate formed article 12 and the target formed article 14 are illustrated and the peripheral portions thereof are not illustrated.

Figure 3:
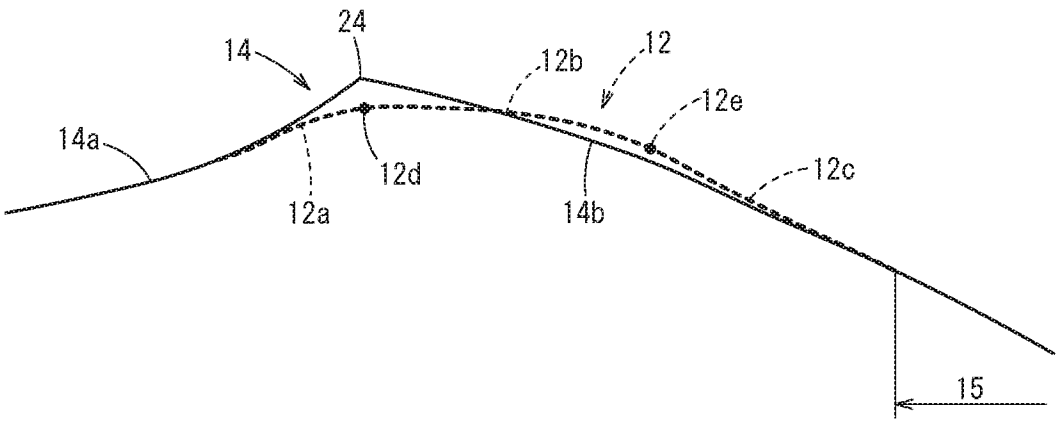
FIG. 3 is a diagram in which an intermediate formed article and a target formed article are superimposed on each other and describes the basic concept of the present invention.

In the target formed article 14 in FIG. 3, the upper surface is a design surface and an edge-shaped ridge portion 24 extending in the direction orthogonal to the paper surface is formed on the design surface. The target formed article 14 has a negative surface 14*a* on one side and a positive surface 14*b* on the other side with respect to the ridge portion 24 as the border. Here, the negative surface is a concave surface when the design surface is seen from the front and the positive surface is a convex surface when the design surface is seen from the front.

The intermediate formed article 12 has an intermediate ridge portion 26 with a radius larger than the edge radius of the ridge portion 24 of the target formed article 14. A first intermediate positive surface 12*a*, a second intermediate positive surface 12*b*, and an intermediate negative surface 12*c* are continuously formed in this order on the intermediate formed article 12, and the intermediate ridge portion 26 is configured by the first intermediate positive surface 12*a* and the second intermediate positive surface 12*b*. The curvature radius of the second intermediate positive surface 12*b* is larger than the curvature radius of the first intermediate positive surface 12*a* and the curvature radius of the intermediate negative surface 12*c* is larger than the curvature radius of the first intermediate positive surface 12*a*. In FIG. 2, reference character 12*d* represents the border between the first intermediate positive surface 12*a* and the second intermediate positive surface 12*b* and reference character 12*e* represents the border between the second intermediate positive surface 12*b* and the intermediate negative surface 12*c*.

The region in which the first intermediate positive surface 12*a* of the intermediate formed article 12 is provided is the region that becomes a part of the region in which the negative surface 14*a* of the target formed article 14 is provided. The region in which the second intermediate positive surface 12*b* and the intermediate negative surface 12*c* of the intermediate formed article 12 are provided is the region that becomes the region in which the positive surface 14*b* of the target formed article 14 is provided. The vicinity of the border 12*d* between the first intermediate positive surface 12*a* and the second intermediate positive surface 12*b* is the portion that becomes the ridge portion 24 of the target formed article 14.

The region in which the negative surface 14*a* of the target formed article 14 is provided has the same shape as a region 13A that is present outside the region in which the first intermediate positive surface 12*a* of the intermediate formed article 12 is provided, except the region corresponding to the region in which the first intermediate positive surface 12*a* of the intermediate formed article 12 is provided. A region 15 that is present outside the region in which the positive surface 14*b* of the target formed article 14 is provided has the same shape as a region 13B that is present outside the region in which the intermediate negative surface 12*c* of the intermediate formed article 12 is provided.

FIG. 3 illustrates the state in which the intermediate formed article 12 and the target formed article 14 are superimposed so that the above regions are aligned with each other, and the portion of the intermediate formed article 12 that has a shape that differs from the target formed article 14 (the portion of the intermediate formed article 12 that does not overlap the target formed article 14) is represented by a dotted line. The up-down direction in FIG. 3 is the press stroke direction. The vicinity of the border 12*d* between the first intermediate positive surface 12*a* and the second intermediate positive surface 12*b* is the vertex of the intermediate formed article 12 seen in the press stroke direction, and the ridge portion 24 is the vertex of the target formed article 14 seen in the press stroke direction. The vertex of the intermediate formed article 12 is located lower in the press stroke direction than the vertex of the target formed article 14. In addition, the second intermediate positive surface 12*b* of the intermediate formed article 12 intersects with the positive surface 14*b* of the target formed article 14.

A first intermediate positive surface 12*a*-formed region of the intermediate formed article 12 bent in a predetermined direction in the first process is bent in the opposite direction in the second process and becomes a negative surface 14*a*-formed region of the target formed article 14. Accordingly, the remaining stresses (tensile and compression stresses) generated in the first intermediate positive surface 12*a*-formed region are removed or relaxed in the second process, and the generation of strains is suppressed. In addition, an intermediate negative surface 12*c*-formed region of the intermediate formed article 12 bent in a predetermined direction in the first process is bent in the opposite direction in the second process and becomes a positive surface 14*b*-formed region of the target formed article 14. Accordingly, the remaining stresses (tensile and compression stresses) generated in the intermediate negative surface 12*c*-formed region are removed or relaxed in the second process, and the generation of strains is suppressed. Although a second intermediate positive surface 12*b*-formed region of the intermediate formed article 12 is bent in the same direction in the second process, the strains generated in the target formed article 14 as a whole are suppressed as much as possible.

Next, an embodiment of the present invention applied to the hood of an automobile as well as matters concerning peripheral portions of an intermediate formed article and a target formed article will be described in details below with reference to FIGS. 4 to 8. Drawing forming is performed in the second process in the embodiment.

Figure 4:
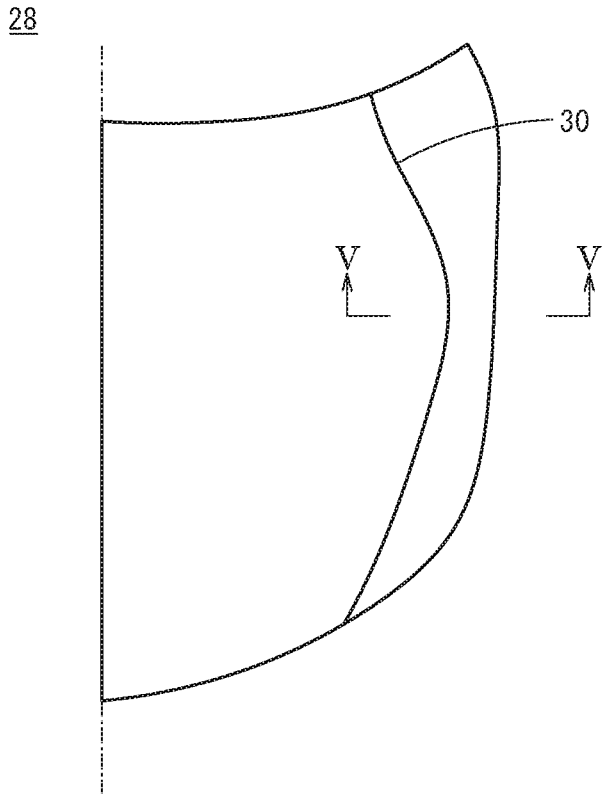
FIG. 4 is a schematic view illustrating a hood of an automobile to which an embodiment is applied.

The left half of an outer panel 28 of the hood is illustrated in FIG. 4. The outer panel 28 has a ridge portion 30 extending substantially in the front-rear direction of the automobile. As described later, this outer panel 28 is obtained by cutting out the unnecessary portion from a target formed article 38. The cross-section of the target formed article 38 corresponding to cross-section V-V of the outer panel 28 in FIG. 4 is illustrated in FIG. 5B. However, FIG. 5B also illustrates the cross-section of the above portion having been cut out.

Figure 5A:
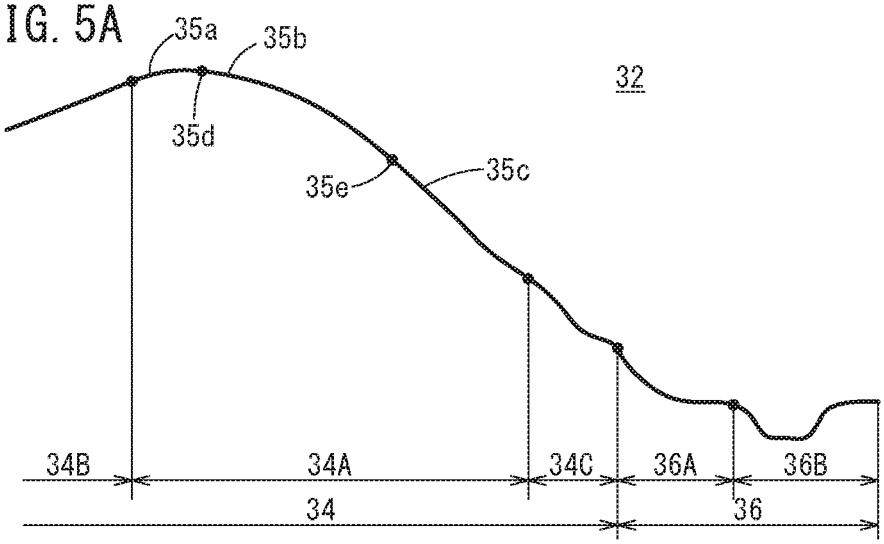
FIG. 5A illustrates the intermediate formed article in the embodiment.
Figure 5B:
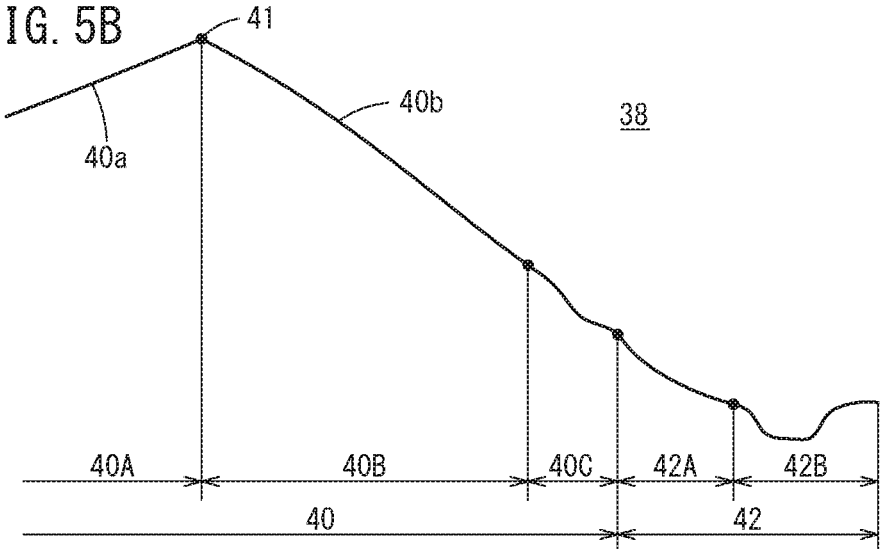
FIG. 5B illustrates the target formed article in the embodiment.

As illustrated in FIG. 5A, an intermediate formed article 32 formed in the first process has a main portion 34 and a peripheral portion 36 provided outside the main portion 34. The main portion 34 of the intermediate formed article 32 has an intermediate shape portion 34A in which a first intermediate positive surface 35*a*, a second intermediate positive surface 35*b*, and an intermediate negative surface 35*c* are provided. The main portion 34 of the intermediate formed article 32 further has a first constant shape portion 34B extending on one side of the intermediate shape portion 34A and a second constant shape portion 34C extending on the other side thereof with the intermediate shape portion 34A sandwiched therebetween. The first constant shape portion 34B is the region continuous with the region in which the first intermediate positive surface 35*a* is provided, and the second constant shape portion 34C is the region continuous with the region in which the intermediate negative surface 35*c* is provided. The peripheral portion 36 of the intermediate formed article 32 has an intermediate peripheral shape portion 36A continuous with the second constant shape portion 34C of the main portion 34, and a support portion 36B placed and supported by a blank holder 54 described later.

The curvature radius of the first intermediate positive surface 35*a* is approximately 10 to 40 mm, the curvature radius of the second intermediate positive surface 35*b* is approximately 40 to 70 mm, and the curvature radius of the intermediate negative surface 35*c* is approximately 40 mm or more. In FIG. 5A, reference character 35*d* represents the border between the first intermediate positive surface 35*a* and the second intermediate positive surface 35*b*, and reference character 35*e* represents the border between the second intermediate positive surface 35*b* and the intermediate negative surface 35*c*.

As illustrated in FIG. 5B, the target formed article 38 formed in the second process has a main portion 40 in which an edge-shaped ridge portion 41 is formed, and a peripheral portion 42 provided outside the main portion 40. The main portion 40 of the target formed article 38 has a region 40A in which a negative surface 40*a* is provided, and a region 40B in which a positive surface 40*b* is provided. The region 40A corresponds to the region in which the first intermediate positive surface 35*a* of the intermediate formed article 32 is provided and the first constant shape portion 34B, and the region 40B corresponds to the region in which the second intermediate positive surface 35*b* of the intermediate formed article 32 is provided and the region in which the intermediate negative surface 35*c* is provided. The main portion 40 of the target formed article 38 further has a constant shape portion 40C continuous with the region 40B. The peripheral portion 42 of the target formed article 38 has a peripheral shape portion 42A continuous with the constant shape portion 40C of the main portion 40, and a support portion 42B having the same shape as the support portion 36B of the intermediate formed article 32.

The edge radius of the ridge portion 41 of the target formed article 38 is approximately 1 to 5 mm and this ridge portion 41 becomes the ridge portion 30 of the outer panel 28. The outer panel 28 is obtained by cutting out parts of the peripheral portion 42 and the constant shape portion 40C from the target formed article 38 after completion of the second process.

Figure 5C:
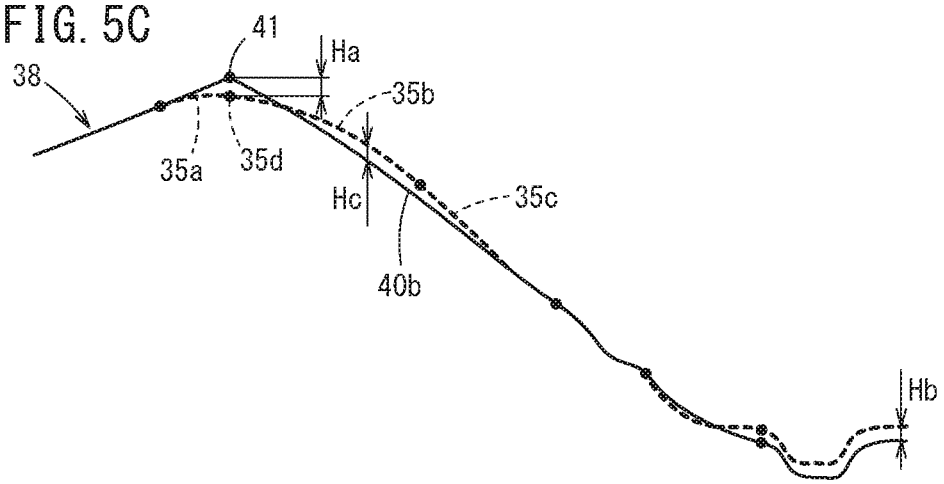
FIG. 5C illustrates the state in which these formed articles are superimposed on each other.

The region 40A of the target formed article 38 has the same shape as the first constant shape portion 34B of the intermediate formed article 32 except the region corresponding to the region in which the first intermediate positive surface 35*a* of the intermediate formed article 32 is provided. In addition, the constant shape portion 40C of the target formed article 38 has the same shape as the second constant shape portion 34C of the intermediate formed article 32. FIG. 5C illustrates the state in which the target formed article 38 and the intermediate formed article 32 are superimposed so that these portions are aligned with each other. The portions in which the intermediate formed article 32 and the target formed article 38 do not overlap are represented by dotted lines.

As illustrated in FIG. 5C, the ridge portion 41 of the target formed article 38 is displaced upward by Ha from the border 35*d* between the first intermediate positive surface 35*a* and the second intermediate positive surface 35*b* in the intermediate formed article 32. The peripheral shape portion 42A of the target formed article 38 has a shape that differs from that of the intermediate peripheral shape portion 36A of the intermediate formed article 32, and the support portion 42B of the target formed article 38 is displaced downward by Hb from the support portion 36B of the intermediate formed article 32. The second intermediate positive surface 35*b* of the intermediate formed article 32 intersects with the positive surface 40*b* of the target formed article 38. The intermediate shape portion 34A of the intermediate formed article 32 is displaced upward from the positive surface 40*b* of the target formed article 38 in the range from an intermediate portion of the second intermediate positive surface 35*b* to the intermediate negative surface 35*c*. If the maximum displacement amount of this portion that is displaced upward is Hc, Hc is smaller than Ha described above and Hb described above is larger than Hc.

In the target formed article 38, the sum of the cross-sectional circumferential length of the region that is part of the region 40A in which the negative surface 40*a* is provided and that does not overlap the intermediate formed article 32, and the cross-sectional circumferential length of the region that is part of the region 40B in which the positive surface 40*b* is provided and that does not overlap the intermediate formed article 32, is slightly larger than the cross-sectional circumferential length of the intermediate shape portion 34A of the intermediate formed article 32. In other words, the cross-sectional circumferential length of the main portion 40 of the target formed article 38 is slightly larger than the cross-sectional circumferential length of the main portion 34 of the intermediate formed article 32. In addition, the cross-sectional circumferential length of the peripheral shape portion 42A of the target formed article 38 is equal to or slightly larger than the cross-sectional circumferential length of the intermediate peripheral shape portion 36A of the intermediate formed article 32. The cross-sectional circumferential lengths here are the lengths along the cross-sectional shapes illustrated in FIGS. 5A to 5C.

Figure 6:
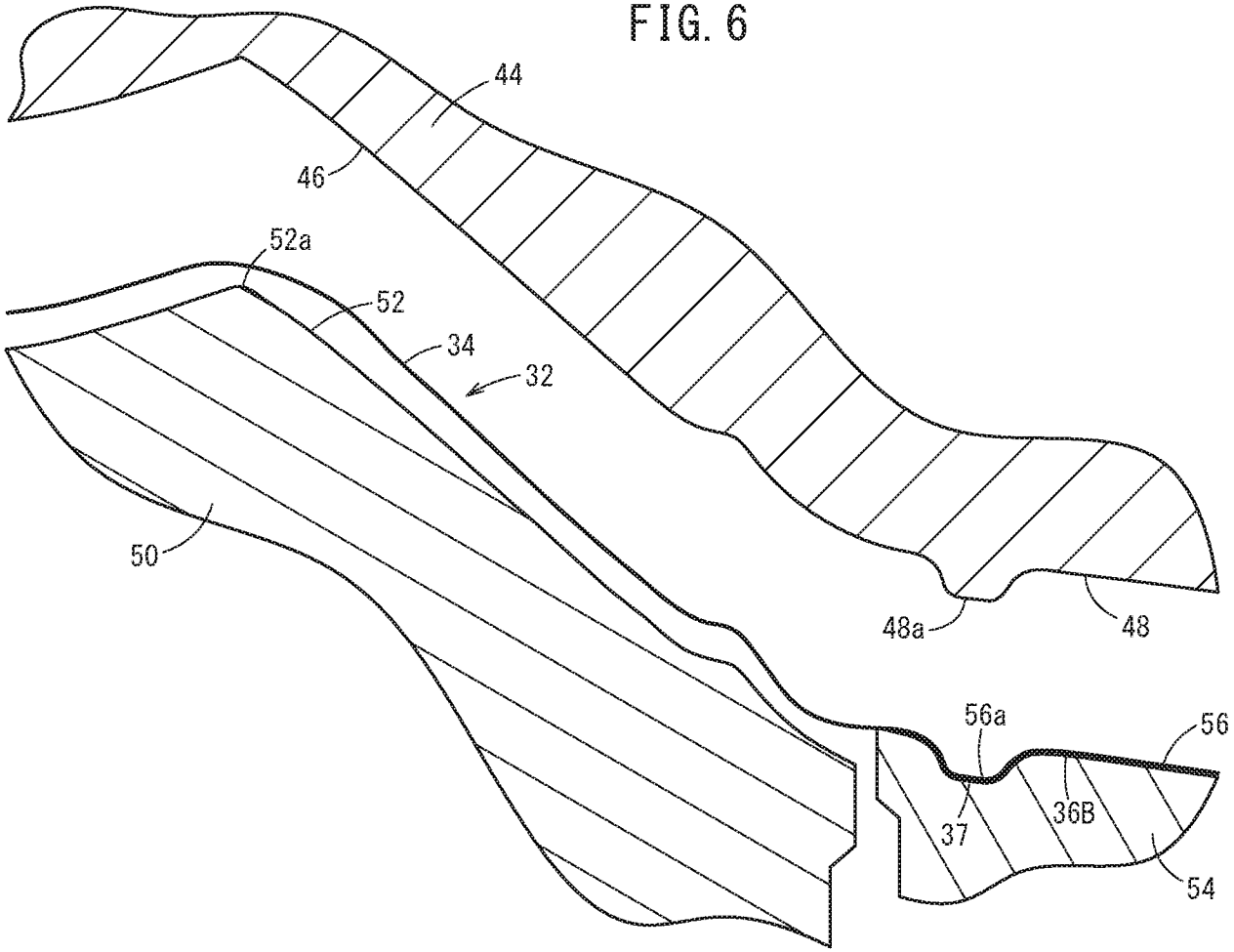
FIG. 6 illustrates an initial state in a second process in the embodiment.

As illustrated in FIG. 6, an upper mold 44 and a lower mold 50 are used in the second process for obtaining the target formed article 38 from the intermediate formed article 32 via press forming. In addition, the blank holder 54 that supports the peripheral portion 36 of the intermediate formed article 32 is used. The upper mold 44 is of movable type and the lower mold 50 is of fixed type. The blank holder 54 is supported in the state in which the blank holder 54 is biased upward by an elastic body such as a gas cylinder (not illustrated).

The blank holder 54 has a support surface 56 that matches the support portion 36B of the intermediate formed article 32, and has a recessed portion 56*a* into which a convex portion 37 formed on the support portion 36B of the intermediate formed article 32 so as to project downward is inserted. The upper mold 44 has a forming surface 46 that forms the intermediate formed article 32 between the forming surface 46 and a forming surface 52 of the lower mold 50, and has a support surface 48 that supports the intermediate formed article 32 between the support surface 48 and the support surface 56 of the blank holder 54. The support surface 48 of the upper mold 44 is provided with a convex portion 48*a* to be inserted into the back side of the convex portion 37 provided on the support portion 36B of the intermediate formed article 32.

The upper mold 44 is movable in a direction (up-down direction) in which the upper mold 44 approaches or separates from the lower mold 50 and the blank holder 54. The forming surface 46 of the upper mold 44 has a shape that prevents the main portion 34 of the intermediate formed article 32 from making contact with the forming surface 46 when the convex portion 48*a* of the upper mold 44 is inserted into the back side of the convex portion 37 provided in the support portion 36B of the intermediate formed article 32. This establishes the above relationship Hb>Hc between the intermediate formed article 32 and the target formed article 38.

The forming surface 52 of the lower mold 50 is provided with an edge portion 52*a* for forming the ridge portion 41 on the target formed article 38. The blank holder 54 is movable with respect to the lower mold 50 in the up-down direction between the position moved downward from the position at which the end portion of the forming surface 52 of the lower mold 50 is aligned with the end portion of the support surface 56 of the blank holder 54, and the position at which these end portions are aligned. A predetermined clearance is provided between the adjacent side surfaces of the blank holder 54 and the lower mold 50.

Next, the operation of the upper mold 44 and the lower mold 50 in the second process will be described. As illustrated in FIG. 6, in the initial state, the support portion 36B of the intermediate formed article 32 is placed on the blank holder 54 and the upper mold 44 and the lower mold 50 are away from the intermediate formed article 32.

Figure 7:
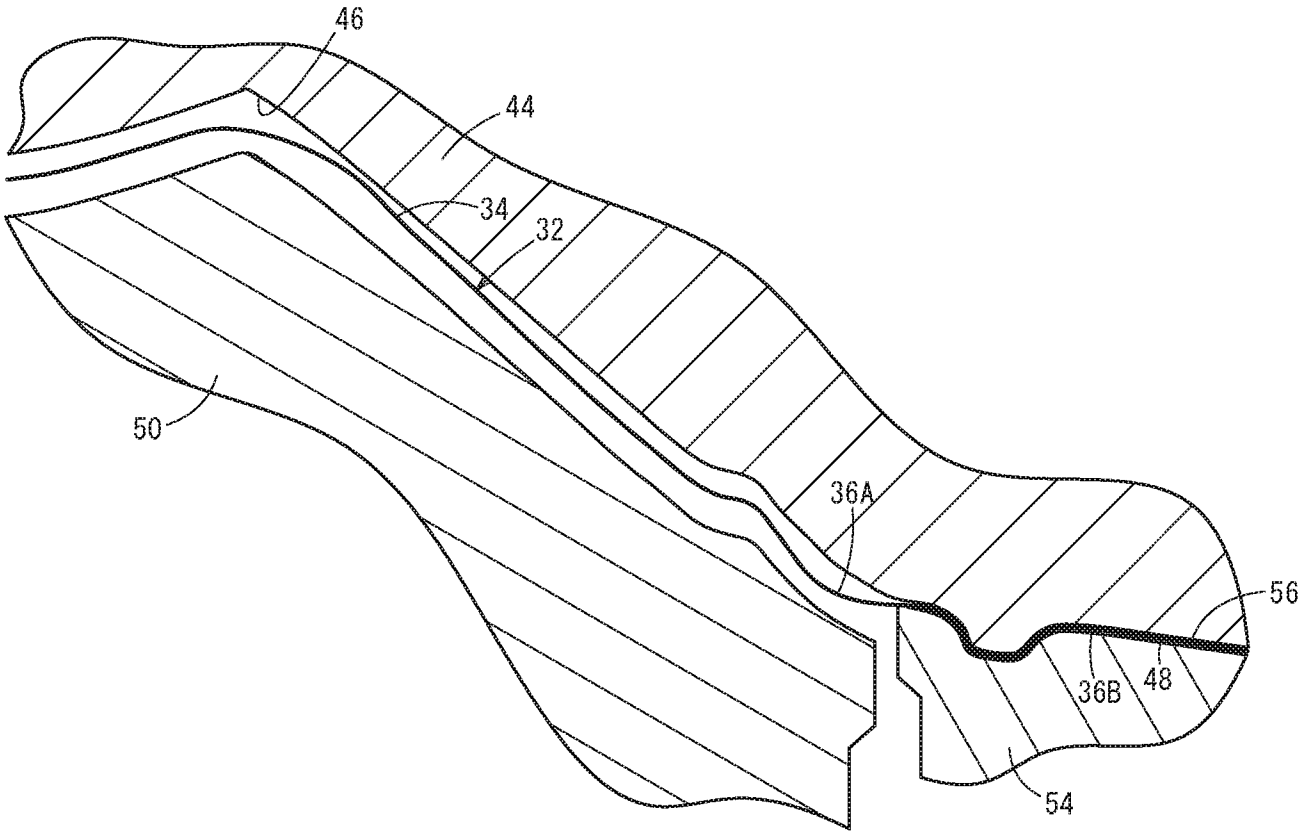
FIG. 7 illustrates a first operating state in the second process in the embodiment.

As illustrated in FIG. 7, when the upper mold 44 is lowered toward the blank holder 54 from the initial state described above, the support surface 48 of the upper mold 44 makes contact with the support portion 36B of the intermediate formed article 32, and the intermediate formed article 32 is sandwiched between the support surface 56 of the blank holder 54 and the support surface 48 of the upper mold 44 in the support portion 36B. At this time, the forming surface 46 of the upper mold 44 is not in contact with the main portion 34 and the intermediate peripheral shape portion 36A of the intermediate formed article 32. Accordingly, the intermediate formed article 32 is not deformed by the upper mold 44 when the intermediate formed article 32 is sandwiched and supported between the blank holder 54 and the upper mold 44.

Figure 8:
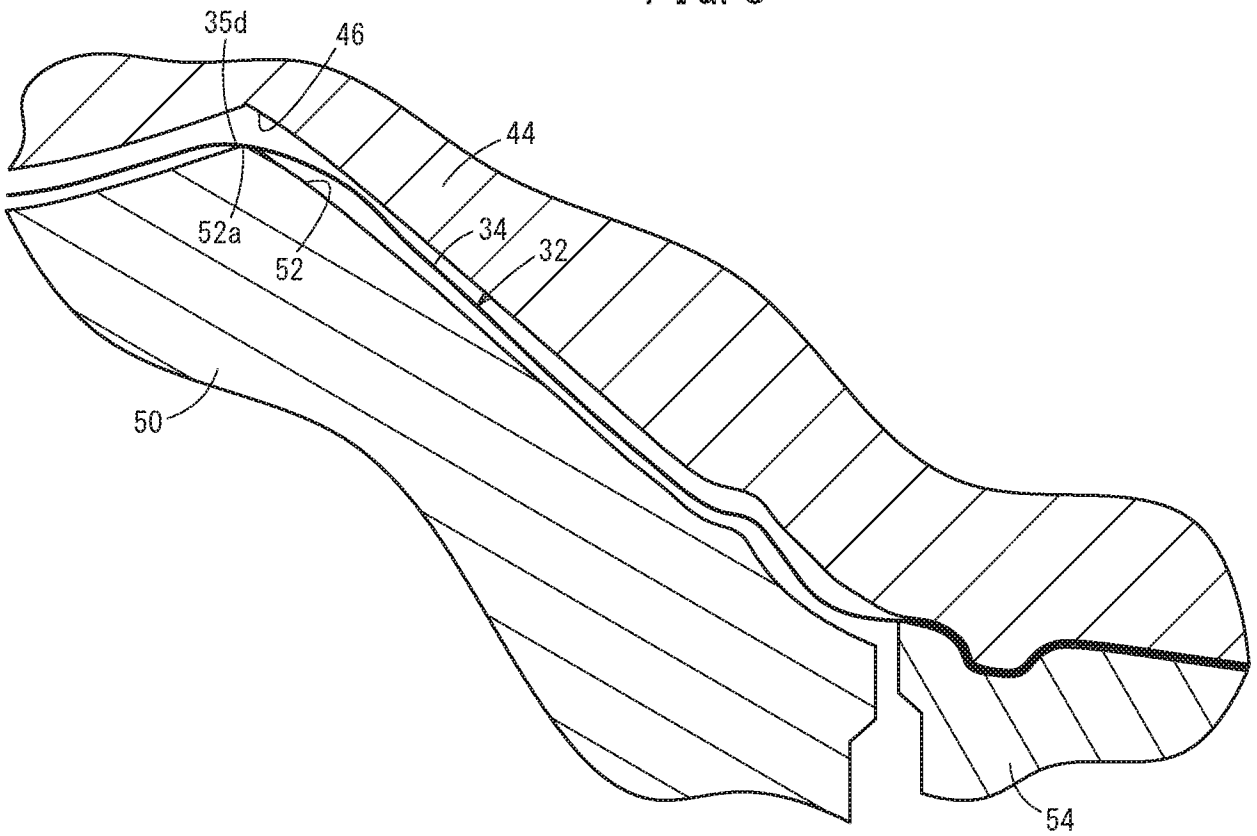
FIG. 8 illustrates a second operating state in the second process in the embodiment.

When the upper mold 44 is further lowered as illustrated in FIG. 8 after the support portion 36B of the intermediate formed article 32 is supported between the blank holder 54 and the upper mold 44, the edge portion 52*a* of the lower mold 50 first makes contact with the vicinity of the border 35*d* between the first intermediate positive surface 35*a* and the second intermediate positive surface 35*b* of the intermediate formed article 32. At this time, the forming surface 46 of the upper mold 44 is not in contact with the main portion 34 of the intermediate formed article 32 yet. Accordingly, the ridge portion 41 of the target formed article 38 is formed in preference to other portions. In addition, this establishes the above relationship Hc<Ha between the intermediate formed article 32 and the target formed article 38.

After that, when the upper mold 44 is further lowered in the state in which the support portion 36B of the intermediate formed article 32 is supported between the blank holder 54 and the upper mold 44, the distance between the forming surface 46 of the upper mold 44 and the forming surface 52 of the lower mold 50 is reduced, the intermediate formed article 32 is formed in a predetermined shape, and the target formed article 38 is obtained. Since the cross-sectional circumferential length of the main portion 40 of the target formed article 38 is slightly larger than the cross-sectional circumferential length of the main portion 34 of the intermediate formed article 32 as described above, the intermediate shape portion 34A of the intermediate formed article 32 is formed while being elongated at a predetermined elongation rate.

The press forming method according to the present invention is not limited to the above embodiment, and various forms can of course be adopted without departing from the gist of the present invention.

REFERENCE SIGNS LIST 12, 32: intermediate formed article
12*a*, 35*a*: first intermediate positive surface
12*b*, 35*b*: second intermediate positive surface
12*c*, 35*c*: intermediate negative surface
14, 38: target formed article
14*a*, 40*a*: negative surface
14*b*, 40*b*: positive surface
24, 41: ridge portion
26: intermediate ridge portion

The invention claimed is:

1. A press forming method, comprising:
- a first process for forming an intermediate formed article having an intermediate ridge portion formed during the first process, the first process comprising:
  - bending a plate member into the intermediate formed article by press forming the plate member with a first upper mold and a first lower mold to:
    - bend a first intermediate positive surface formed region of the intermediate formed article in a first predetermined direction,
    - bend a second intermediate positive surface formed region of the intermediate formed article in the first predetermined direction, and
    - bend an intermediate negative surface formed region of the intermediate formed article in a second predetermined direction; and
- a second process for forming a target formed article from the intermediate formed article, the second process comprising:
  - bending the intermediate formed article into the target formed article by press forming the intermediate formed article with a second upper mold and a second lower mold to:
    - bend the first intermediate positive surface formed region of the intermediate formed article in a first opposite direction, opposite the first predetermined direction, into a negative surface formed region of the target formed article, and bend the intermediate negative surface formed region of the intermediate formed article in a second opposite direction, opposite the second predetermined direction, into a positive surface formed region of the target formed article, opposite the negative surface formed region wherein the target formed article has an edge-shaped ridge portion and the negative surface formed region on one side, and the positive surface formed region on another side with respect to the edge-shaped ridge portion as a border, the intermediate ridge portion has a radius larger than an edge radius of the edge-shaped ridge portion, the first intermediate positive surface formed region corresponds to a first section of the target formed article, wherein the first section extends from the edge-shaped ridge portion to the negative surface formed region, and the second intermediate positive surface formed region is continuous with the first intermediate positive surface formed region and the intermediate negative surface formed region is continuous with the second intermediate positive surface formed region, the second intermediate positive surface formed region and the intermediate negative surface formed region correspond to a second section of the target formed article, wherein the second section extends from the edge-shaped ridge portion to the positive surface formed region.

2. The press forming method according to claim 1, wherein the target formed article and the intermediate formed article have identical shapes in regions on both sides of the intermediate ridge portion and a vertex of the intermediate formed article is located lower in a press stroke direction than a vertex of the target formed article.

3. The press forming method according to claim 2, wherein the second intermediate positive surface formed region intersects with the positive surface formed region, and in a state in which a region of the target formed article and a region of the intermediate formed article are superimposed on each other, in the regions, the target formed article and the intermediate formed article have the same shape.

* * * * *